US005310326A

United States Patent [19]

Gui et al.

[11] Patent Number: 5,310,326

[45] Date of Patent: May 10, 1994

[54] ROTARY COMPRESSOR WITH IMPROVED BORE CONFIGURATION AND LUBRICATION SYSTEM

[75] Inventors: Fulin Gui; Robert P. Scaringe, both of Rockledge, Fla.

[73] Assignee: Mainstream Engineering Corporation, Rockledge, Fla.

[21] Appl. No.: 944,321

[22] Filed: Sep. 14, 1992

[51] Int. Cl.[5] ..... F04C 18/344; F04C 29/02

[52] U.S. Cl. ..... 418/76; 418/77; 418/99; 418/150; 418/152; 418/179; 418/189; 418/236; 418/259; 418/270; 418/DIG. 1

[58] Field of Search ..... 418/76, 77, 99, 150, 418/152, 179, 189, 236, 238, 259, 270, DIG. 1

[56] References Cited

U.S. PATENT DOCUMENTS

| | | | |
|---|---|---|---|
| 2,057,381 | 10/1936 | Kenney et al. | 418/150 |
| 2,491,351 | 12/1949 | Zeitlin | 418/150 |
| 3,121,528 | 2/1964 | Rhodes | 418/152 |
| 3,809,511 | 5/1974 | Linder et al. | 418/259 |
| 3,820,924 | 6/1974 | Cassidy | 418/DIG. 1 |
| 4,299,097 | 11/1981 | Shank et al. | 418/150 |
| 4,507,065 | 3/1985 | Shibuya et al. | 418/99 |
| 5,049,052 | 9/1991 | Aihara | 418/179 |

FOREIGN PATENT DOCUMENTS

| | | | |
|---|---|---|---|
| 2725238 | 12/1977 | Fed. Rep. of Germany | 418/259 |
| 55-112893 | 9/1980 | Japan | 428/189 |
| 58-62398 | 4/1983 | Japan | 418/236 |
| 2119692 | 5/1990 | Japan | 418/259 |
| 3242490 | 10/1991 | Japan | 418/77 |

*Primary Examiner*—John J. Vrablik

*Attorney, Agent, or Firm*—Evenson, McKeown, Edwards & Lenahan

[57] ABSTRACT

A rotary compressor, such as a sliding vane compressor, comprises a housing having a bore, a rotor assembly operatively arranged to rotate within the bore, vanes operatively arranged at the rotor assembly to move linearly relative to the rotor assembly and to form, together with the housing and rotor assembly, variable chambers, and a valve assembly arranged in the housing. The bore has a configuration divided into a expansion region of elliptical shape, a circular transition region, a polynomial-shaped compression region and a circular sealing region. The lubricant seal is composed of an oil injection port and oil grooves for trapping and transporting the oil. The valve assembly is provided in a recess portion of the housing and is configured as a thin blade covering each discharge port which has been relieved to minimize undesirably large difference of the pressure forces between the two sides of the blade. Oil grooves are provided in the rotor assembly and in end cap assemblies. In addition, the area seal and lubricant seal can be utilized in other types of compressors such as a rolling piston-type rotary compressor.

26 Claims, 8 Drawing Sheets

ROTARY COMPRESSOR WITH IMPROVED BORE CONFIGURATION AND LUBRICATION SYSTEM

BACKGROUND AND SUMMARY OF THE INVENTION

The present invention relates to a rotary compressor and, more particularly, to a reliable, extremely high pressure ratio, high efficiency, and lightweight sliding-vane rotary-compressor which has application in heat pump, air conditioning, and refrigeration (vapor-compression) applications as well as for the compression of other fluids such as air, nitrogen, and argon. The compressor can be configured as a lubrication-free device utilizing self-lubricating materials or as an oil lubricated device with very high compression ratio capability.

Conventional vane compressors have a relatively low pressure capability, i.e. somewhere in the range of 65 psi. Moreover, these compressors have insufficient volumetric and overall thermal efficiency for use in today's environment where high efficiency components are necessary for heat pumps, refrigeration equipment and air-conditioning units. Also, the conventional compressors are not completely compatible with the newer, environmentally safe refrigerants such as R-134a.

In applications such as aircraft or electronics cooling systems where low weight, small size, reliability, and efficiency are important criteria, as well as in refrigerant recovery apparatus where stringent thermal requirements exist, both the conventional sliding-vane compressors and other types of compressors such as reciprocating compressors are unacceptable. The conventional vane compressors do not provide adequate pressure ratio, and the other types of compressors are too heavy and are also difficult to obtain a high pressure through one stage. Moreover, the reciprocating compressors have considerable intake losses (pressure drop) and large reciprocating acceleration forces that result in rough operation of the compressor. This kind of compressor also require a relatively large starting torque and hence a large motor.

It is, therefore, an object of the present invention to develop a lightweight, high compression ratio rotary compressor to overcome or eliminate the problems and disadvantages associated with both conventional vane compressors and the other types of compressors, particularly those compressors designed for use in compact cooling and refrigerant recovery application where extreme high pressure ratio exists.

It is another object of the present invention to provide compressors, particularly sliding-vane rotary compressors, configured adequately to solve the problems of frictional heat, internal leakage, and low pressure capacity encountered in conventional rotary compressors.

It is a further object of the present invention to configure a sliding-vane rotary compressor which maximizes compression ratio, flow rate, and thermodynamic and volumetric efficiency.

Yet another object of the present invention is to provide a structurally simple sliding-vane rotary compressor, especially useful in micro-climate cooling systems and refrigerant recovery systems, which is lightweight, reliable, adaptable to unusual thermal requirements, smooth running, and operable with small initial starting torque.

Still a further object of the present invention is to configure a sliding-vane rotary compressor that is particularly suitable for high compression ratio of more than 100:1 in one stage.

The foregoing objects and advantages of the present invention have been achieved with a sliding-vane rotary compressor having an improved bore geometry, vane slot arrangement, valve assembly, and injected lubrication sealing effects which permit, by way of example, gas or vapor to be drawn at low pressure (say, 2.5 psia) and discharged at high pressure (say, 365 psia) in one stage.

The bore geometry of the rotary compressor of the present invention is such that the curvature used is neither a single circle nor a single ellipse, as in conventional rotary compressors. In the present invention, the outline of the bore has been configured, through a computer program, to have the best mechanical and thermodynamic performance, i.e., to maximize the inlet flow in the inlet area and maximize the compression ratio in the compression area, to minimize the dead volume and keep low exhaust resistance, to minimize the internal leakage and maximize the volume efficiency, to minimize the frictional heating, and, to increase thermodynamic efficiency.

A sliding-vane rotary compressor incorporating the features of the present invention has the following advantages:

1. Much higher pressure capability, up to about 450 psi or more as compared with conventional vane compressors with pressure capability of only 65 psia;
2. Extremely high compression ratio;
3. Improved volumetric and overall thermal efficiency;
4. Improved internal sealing because of the sealing effect of injected lubricant resulting in high volumetric flow rates as well as the aforementioned high pressure capability and high pressure ratios;
5. Low friction resulting in reduced wear, increased life, less frictional heat, and high efficiency;
6. Compact size; and
7. Compatibility with all refrigerants including the more environmentally safe refrigerants.

BRIEF DESCRIPTION OF THE DRAWINGS

These and further objects, features and advantages of the present invention will become more readily apparent from the following detailed description of a currently preferred embodiment when taken in conjunction with the accompanying drawings wherein.

DETAILED DESCRIPTION OF THE DRAWINGS

Figure 1:
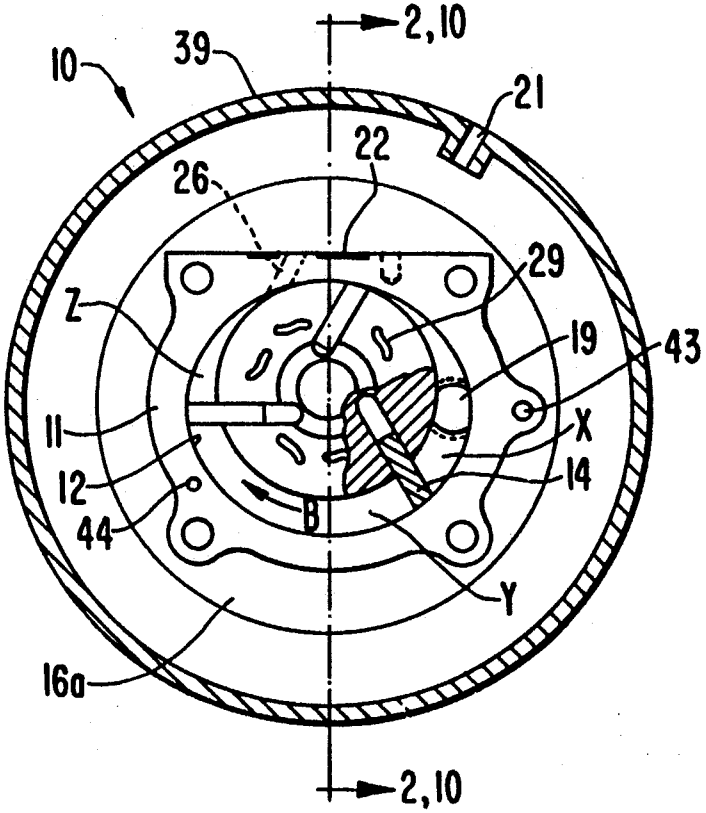
FIG. 1 is an elevational, front view of the assembled sliding-vane rotary compressor, with one side of the end-disk and end cap, and the valve assembly removed and a portion of the rotor cut away incorporating the principles of the present invention.
Figure 2:
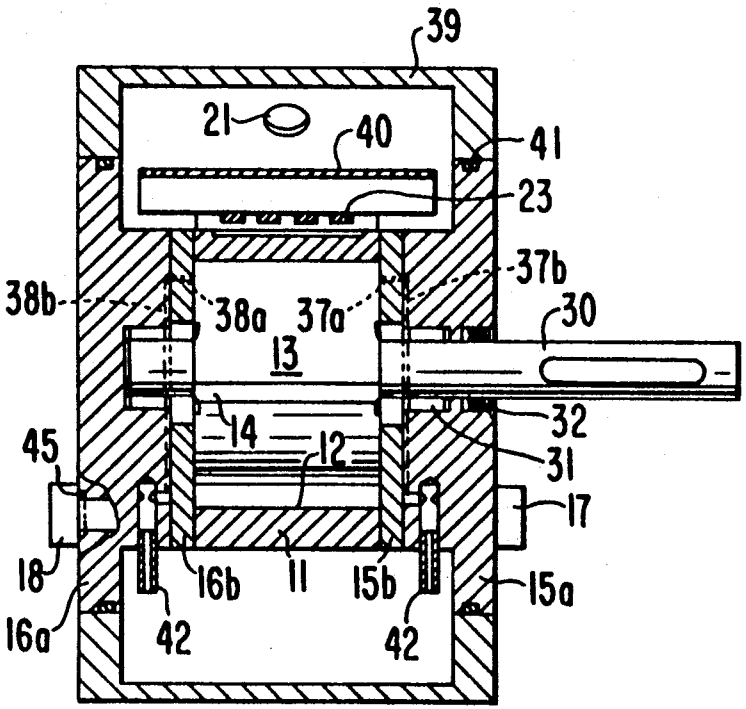
FIG. 2 is a cross-sectional view taken in the direction shown by the arrows 2, 10 in FIG. 1 but with both end caps, the valve assembly and the oil baffle installed on the compressor.
Figure 8:
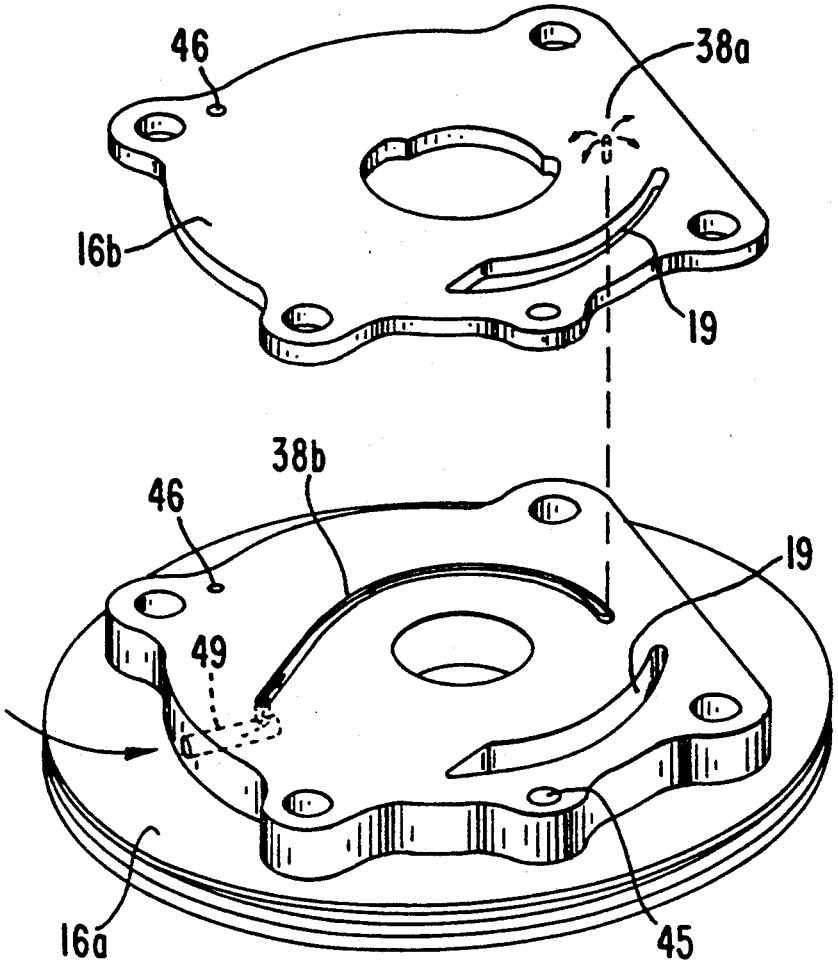
FIG. 8 is an isolated, perspective exploded view of a pair of an end-disk and end-cap illustrating the structure of the engraved oil supply line between the end-disk and end-cap.

Referring now to the drawings and, in particular, to FIGS. 1 and 2, the compressor is designated generally by the numeral 10 and comprises a bore housing 11 having a bore 12 therethrough, a rotor assembly 13 arranged in the bore 12, and vanes 14. The illustrated embodiment shows a three-vane arrangement. A combination of the bore 12, the rotor assembly 13, and the vanes 14 forms three variable chambers X, Y, Z for gas suction, displacement, and compression. It should be understood, of course, that different numbers of vanes can be selected depending on the desired volumetric flow rate and pressure ratio, and also whether an exhaust valve will be used. The compressor bore housing 11 can be fabricated, for example, from nodular cast iron, e.g. 100-70-03 (A 536), the rotor assembly 13 from 4340 alloy, and the vanes 14 from a self-lubricating polyimide material marketed by DuPont under "VESPEL 211" trademark. End-caps 15*a*, 16*a* and end-disks 15*b*, 16*b* are provided on each face of the compressor housing 11 and are secured thereto in a conventional manner by way of four respective bolts 17, 18 on each side of the housing. The end-cap 16*a* and end-disk 16*b* are provided, as seen in FIG. 8, with an axial suction port 19 through which gas to be compressed is drawn into the compressor 10.

The rotor assembly 13 includes a rotor shaft 30 passing through end-cap 15*a* and end-disk 15*b*. The shaft 30 is supported on a suitable conventional needle bearing 31 arranged in the end cap 15*a*. An external seal 32, also of conventional construction, is provided between the shaft 30 and the end-cap 15*a* to prevent leakage of gas and lubricant through the end cap 15*a*.

Figure 6:
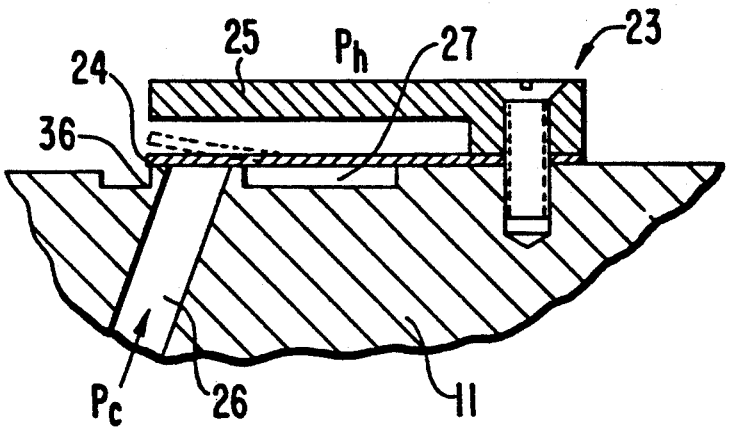
FIG. 6 is a cross-sectional side view of the valve assembly on the compressor housing.
Figure 7:
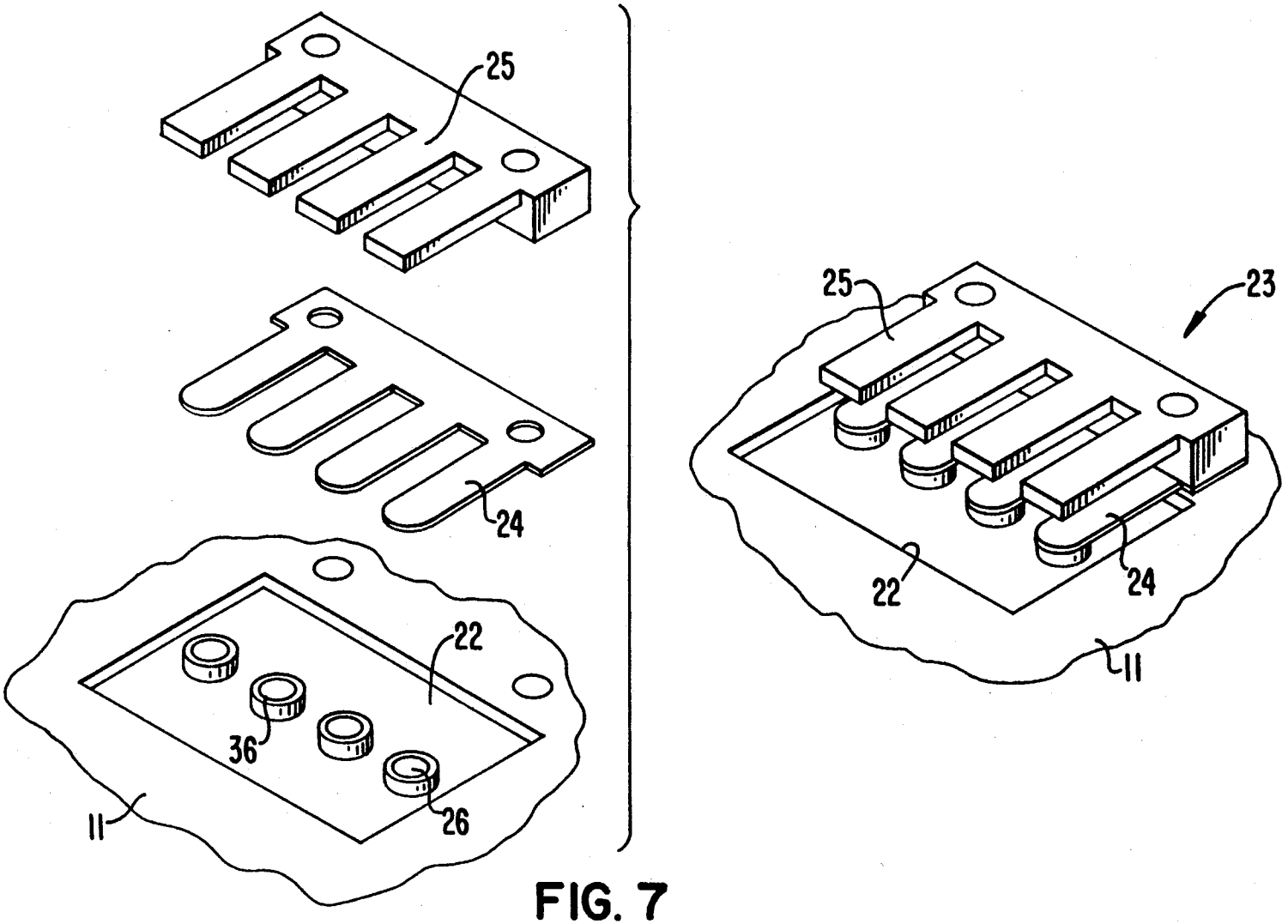
FIG. 7 is an isolated perspective view of the valve assembly shown in FIG. 6 and exploded to show the two major components thereof.

As shown in FIG. 2, the top of the compressor 10 is provided with a valve assembly designated generally by numeral 23 and shown in greater detail in FIGS. 6 and 7. The valve assembly is secured to the flat top of the compressor bore housing 11. The valve assembly 23 has two components, namely a very thin, flexible valve blade 24 in the form of individual fingers corresponding to the number of discharge ports 26 in the compressor housing 11 and a retainer 25, which is secured to the housing 11 through conventional screws or bolts, also having the same number of fingers as the blade 24 to limit upward movement of the valve blade fingers off the discharge ports 26. The valve blade 24 can be about 0.005 inch thickness to reduce the bending forces for opening and to provide a rapid dynamic response. Spring steel possesses sufficient elasticity for this purpose. It will be understood that the rest position of the valve assembly is shown in solid line in FIG. 6 and also on the right hand side of FIG. 7 whereas the discharge position is shown by the dashed lines in FIG. 6.

As shown in FIG. 6, the pressure of the gas inside the housing 11 is designated $P_c$ and the pressure outside the housing 11 is designated as $P_h$. When the compressor 10 is running under rated load, the outside $P_h$ is approximately constant whereas the inside pressure $P_c$ varies cyclically. When $P_c$ is larger than $P_h$, the stiffness of the fingers of the valve blade 24 will be overcome so as to push the valve blade 24 upwardly as shown by the dotted lines in FIG. 6 to permit the compressed gas to flow out of the housing. Since the valve blade 24 is thin (about 0.005 inch), it is easily lifted to reduce the discharge pressure ($P_h - P_c$). The recessed area 22 serves as a pressure balance for the pressure forces exerted on the top and bottom sides of the blade 24. This, in turn, reduces the discharge pressure and results in increased compressor thermal efficiency.

Figure 3:
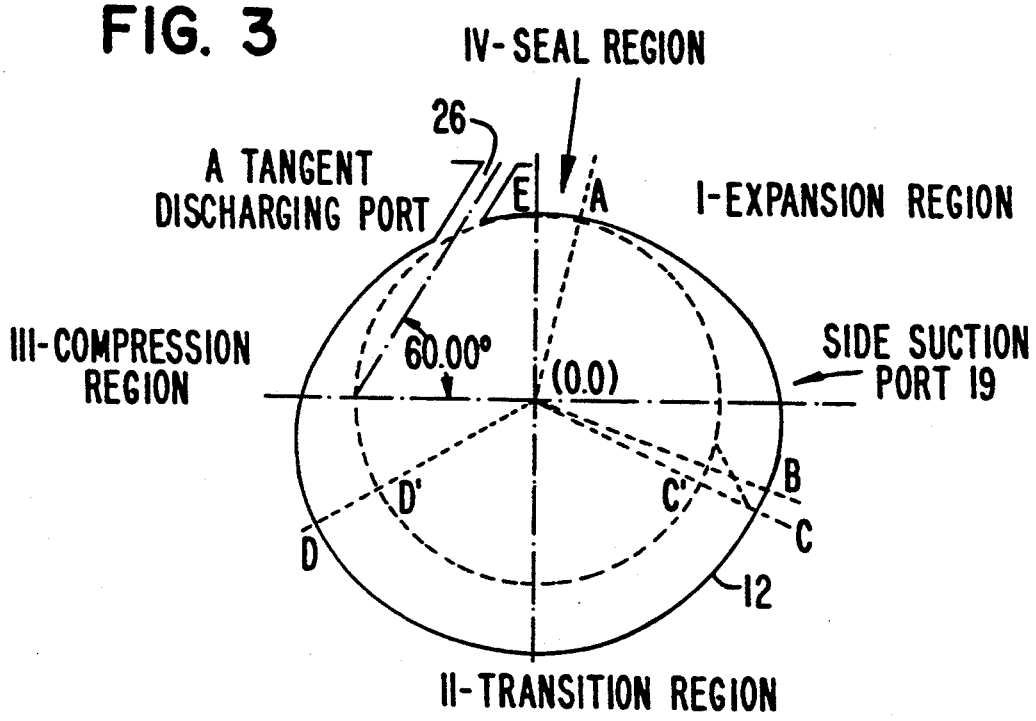
FIG. 3 is an isolated view of the bore configuration of the compressor shown in FIG. 1 illustrating the several working regions and bore geometry.

Referring to FIG. 3, the compressor 10 draws in gas on the right hand side through the side suction port 19 in the end-cap 16*a* and end-disk 16*b* to provide an axial inlet flow into the compressor 10. As the rotor 13 rotates clockwise, as shown by the arrow B in FIG. 1, the gas sucked in through the port 19 is compressed as it moves to the left hand side of the compressor 10 through the transition region (II) as shown in FIG. 3 and is discharged radially through the discharge ports 26 in the housing 11.

All known sliding vane compressors use, however, either a circular bore with off-set center line or a single ellipse. The performance of the compressor of the present invention is markedly improved over these known compressors because of the unique bore configuration which is divided into four regions; expansion (I), transition (II), compression (III), and seal (IV) regions which can be summarized as follows:

| Region | Location | Curvature | Function |
|---|---|---|---|
| I | A-B | Ellipse | Expansion |
| II | B-D | Circle | Transition |
| III | D-E | Specially Modified (Polynomial) Ellipse | Compression |
| IV | E-A | Circle | Provide large seal area |

Each region uses a different type of bore curvature, from a simple circle to provide a large sealing area to a modified ellipse to maximize compression. The bore configuration is made by a CNC machine according to a copyrighted FORTRAN program owned by applicants' assignee, Mainstream Engineering Corporation of Rockledge, Fla. This program is machine implementable to calculate the coordinates of the compressor bore in terms of selected bore parameters (specifically, rotor radius and vane extending length), to calculate the velocity and acceleration of the vane, and thus to provide and control the circumference of the bore profile (or the center path of a CNC machine end-mill) as represented by the following source code in which bore profile circumference (or center path) are in the cartesian coordinate system and in which

```
      r_rotor -- rotor radius
      rmin, rmax — min. and max. radius
      a -- the angle at which the first ellipse starts
      b -- the angle at which the first ellipse ends the
          large circle are begins
      c -- the angle at which the large circle ends and the
          second ellipse begins
      theta -- angle variable (degree)
      r -- radius variable (inch)
      x,y -- point coordinates
      omg -- rotating velocity
      Vt -- tangential velocity
      V -- Radial velocity
      acel -- the tangential acceleration of the vane
      acelratio -- the ratio of the radial accel. to the
                   tangential accl.
      program compbore
      common theta(2100) , r(2100)
      doubleprecision theta,r
      parameter(Pi=3.141593,a=10.,b=110.,c=240.)
      open(20,file= 'bore.dat' ,status = 'unknown')
      open(30,file= 'bore2.dat' ,status= 'unknown')
c initial data setup
c     write(*,*)'This progrom is to determine the profile of
c     write(*,*) ' the bore. please input the r_rotor now'
c     read(*,*) r_rotor
c     write(*,*) 'please input the length the vane sticks out'
c     read(*,*) lv
      write(*,*) 'please input the endmill radius (inch) now'
      read(*,*)rm
c     rm =0.0
      rbmin=r_rotor + .0005
      rmin =rbmin-rm
      rbmax=r rotor+lv
      rmax=rbmax-rm
      omg=2.*Pi*6500/60.
      a1=rmin
      b1=rmax
      thetalm=100.0
      a2=rmax
      b2=rmin
      theta2m=120.0
      n-2000
      write(*,*) 'please input the number of points'
      read(*,*) n
c set theta dimension
      do 100 i=0,n+1
      dtheta=360./n
      theta(i)=dtheta*(i-1)
c     determine the radius as a function of theta
c Region I, the seal region
      if (theta(i).ge.b) goto 20
      r(i)=rmin
C Region II the expansion region 1
      if (theta(i).le.a) goto 100
      thetal=(theta(i)-10.)/thetalm *pi/2.
      r(i)=radius (a1,b1,thetal)
      goto 100
c Region III, the transient region 2
   20 r(i)=rmax
      if (theta(i).le.c ) goto 100
c Region IV, the compression region
      theta2=(theta(i)-c)/theta2m *Pi/2.
      r(i)=radius(a2,b2,theta2)
      goto 100
100   continue
      do 200 i=1,n+1
      vt=omg*r(i)*0.0254
      v=omg*(r(i)-r(i-1))*0.0254
      acel=omg*omg*(r(i)-0.3)*0.0254/9.81
      acelratio=(r(i+1)+r(i-1)-2.*r(i))*pi**2/(r(i)-0.3)
c        write(*,*)i,theta(i),r(i)
      x= r(i)*sin(theta(i)*PI/180.)
      y = r(i)*cos(theta(i)*Pi/180.)
      write(20,1000)theta(i),r(i), x,y
      write(30,2000) x,y
c        if (amod(i-1,5).ne.0) goto 200
c        write(20,1002)theta(i),r(i),vt,acel,v,acelratio
  200 continue
c        do 300 i=1,100
```

-continued

```
c        theta(i)=360./99*(i-1)
c        x=0.7123*sin(theta(i)*pi/180.)
c        y=0.7123*cos(theta(i)*pi/180.)
c300        write(20,2000) x,y
c     to calculate the circumference of the profile
      cL3=0.0
      cL2=0.0
      r(n+1)=r(1)
      theta(n+1)=theta(1)+360.
      do 400 i=2,n+1
      cL2=cL2+r(i)*( (theta(i)-theta(i-1)) *pi/180.)
      cL3=cL3+r(i-1)*( (theta(i)-theta(I-1)) *pi/180.
400 continue
      write\(*, *) 'circomference=', cL2,cL3,' de=',cL2/Pi
1000  format(1x,'|',f6.1,' |',f8.4,2(' |',f8.4),' |')
1002  format(1x,f6.4,4(',',f13.4),',',f9.5)
2000  format(1x, 'X',f7.4,'Y',f7.4)
      Stop
      end
      function radius(a,b,theta)
      radius=a/sqrt( 1.-(1.-a*a/(b*b))*sin(theta)*sin(theta)
)
      end
```

In the inlet or expansion region (I) shown in FIG. 3, the maximization of the inlet flow rate is accomplished by opening the compression chamber, i.e. the space between the rotor 13 and the bore configuration 12, quickly. This region only takes about 100 degrees of crank rotation for the vane 14 to fully extend. This provides the maximum possible volume in the transition region (II). The first or inlet region encompasses A-C-C′ since the suction port section is not isolated from the segment until the trailing-vane 14 of a segment passes point C. The bore curvature 12 changes, however, from a circle to an ellipse at point B. The bore curvature change, at each region, is also restrained so that the curve from the previous region and the curve for the next region are tangential at the point of conjunction. This minimizes accelerations and jerk on the vanes. The second or transition region (C-C′-D′-D) is about 13% larger than would be the case if a single circular bore were used, and much larger than that of an elliptical bore configuration.

The compression region (III) shown in FIG. 3 is an important region because most of the compression work is accomplished there. Also the vane wear, heat generation, fluid leakage, and vibration are greatest in the compression region. All these factors are principally related to the curvature in this third or compression region. We have also recognized the importance of carefully considering both mechanical smoothness and effective thermodynamic performance in determination of the compression curvature which provides for a smooth movement of the vanes. The radial acceleration of the vanes varies gently throughout the compression zone. This reduces vane wear and compressor vibration.

In addition, the compression rate is slow at the beginning (in the area between the transition region (II) and compression region (III)) and very fast in the compression region (III). This arrangement results in two advantages. First, since most thermodynamic compression heat is generated in the compression region (III), the fast compression and discharge reduces the time and the area for the hot compressed air to transfer its heat to the compressor body; hence, the temperature of the compressor is reduced. Significant heating of the inlet gas would cause the gas to expand and thereby undesirably reduce the mass flow rate of the compressor and decrease the maximum compression ratio; the reduction of the compressor temperature also increases the thermodynamic efficiency. Second, the fast compression and discharge also reduces the residence time in the compressor, thereby reducing the internal leakage, and increasing the volumetric and thermodynamic efficiency. The bore curvature of the present invention provides, therefore, a significantly improved pressure capability of this compressor when compared to conventional rotary compressors.

Another major advantageous feature of the compressor bore is the sealing zone (IV) E-A which is between the high pressure or discharge side of the compressor 10 and the low pressure or inlet (suction) side. In contrast with a line seal in a conventional rotary compressor, the compressor 10 uses an area seal that much more effectively reduces the gas leakage from high pressure side to low pressure side. The area seal is brought about by making the radii of both the rotor 13 and the bore 12 in the seal zone as close to each other as possible within practical manufacturing limits.

Figure 5B:
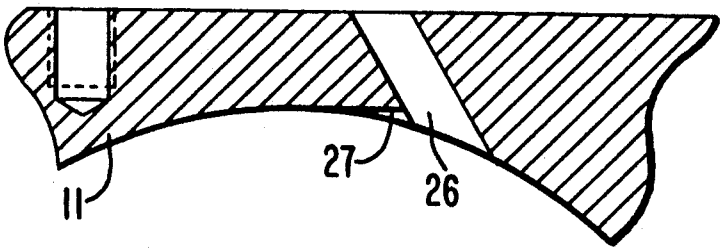
FIG. 5B is a cross-sectional view along line 5B—5B of FIG. 5A.
Figure 5A:
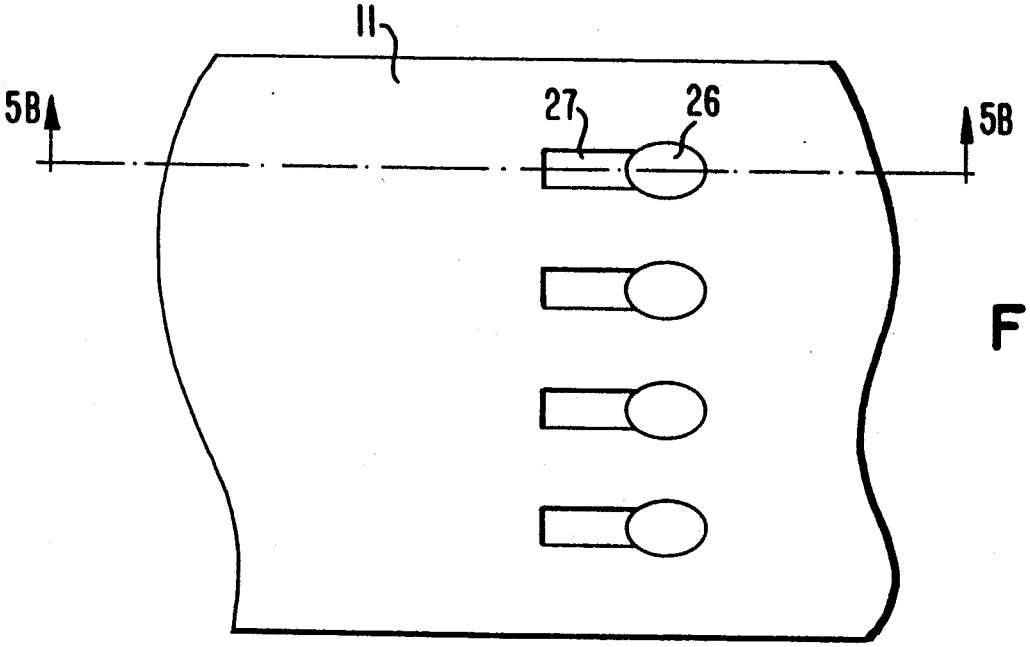
FIG. 5A is a isolated partial view of the discharge ducts and oil release groove on a top part of the compressor bore.

As shown in FIG. 5, the discharging holes 26 in the compressor bore housing 11 are arranged radially to avoid exhaust choking and to minimize pressure drop. Oil release grooves 27, which lead to the discharging holes 26, are located at the entrance of the contact seal zone. A common compressor damage problem is liquid knocking which results from compressing a liquid. Any liquid, such as oil, liquid water, or unvaporized refrigerant, in this area will be smoothly discharged to the exhaust ports 26 without causing any knocking due to the oil release grooves 27. Without these grooves 27, however, liquid which is virtually incompressible in this area would be forced into the seal contact area causing the rotor torque to increase tremendously and resulting in the stalling of the compressor or in undesired displacement of the rotor 13 or vanes 14. Any of these unwanted effects will damage the compressor or, at the very least, decrease its life. The oil release grooves 27 allow the compressor 10 to successfully operate with a liquid volume ratio as high as 50%.

The exhaust ports 26 provide a path for discharging the compressed gas and use the valve assembly 23 to prevent back flow. They are composed of four radial holes 26 in the bore housing 11 and utilize the flapper-type valve assembly 23 on the outside surface of the compressor housing 11. This arrangement makes a smooth streamlined passage to reduce the flow resistance during discharge and reduces the dead volume, i.e. the discharge holes. The discharge holes 26 extend inside the bore as short and close as possible to the seal region (IV). The cross-sectional flow area (i.e., the width between the rotor 13 and the bore 12 multiplied by the length of rotor 13) is just large enough to allow the compressed gas to exit through this space without choking, thereby reducing the dead volume to a minimum. The ports 26 have also been sized and configured to be tangent to the rotor cylinder surface so as to streamline the exhaust flow and further reduce flow resistance.

The rotor 13 is the only rotating part in the compressor 10. The rotor 13 has slots 28 (FIG. 4) therein to house the sliding vanes 14 and drives the vanes 14 to displace and compress the gas by making the variable compression chambers X, Y, Z with the help of the previously discussed bore curvature 12. It also has oil grooves 29 on its two flat faces for trapping lubricant and reducing the fluid shear force between the rotor 13 and the bore 12. These oil grooves 29 also supply the lubricant required for sealing.

The number of the vanes is related to the friction heat generation, seal capability, and initial compression volume. There is friction between the vanes 14, the bore 12, and the rotor 13. For a small size compressor, the unit frictional heat, i.e., the frictional heat generated for a unit of gases, is high. Excessive friction and frictional heat result in the reduction of the intake mass flow rate, because of the thermal expansion of the gas, and the increase of the required unit compression work. Frictional heating is one of the main concerns in the determination of the number of vanes. Three vanes have been selected in the currently preferred embodiment for a refrigeration application because this results in the largest flow rate and least friction heat compared, say, to five vanes. Although a fewer number of the vanes does not provide a high leakage resistance at the tip of the vane, this loss is partially compensated by the above-mentioned rapid compression. In any event the number of vanes can be changed without departing from the present invention.

Figure 4:
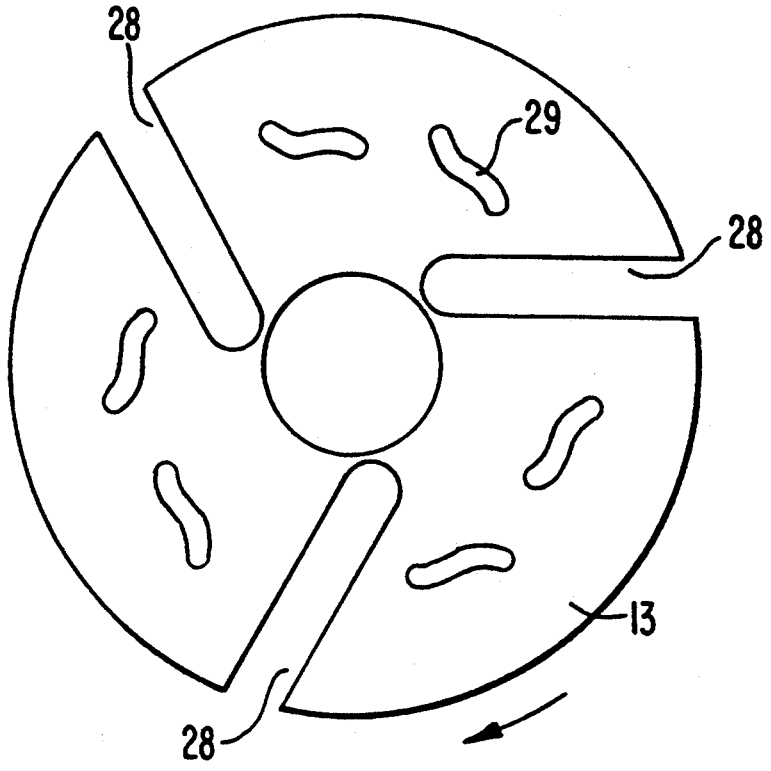
FIG. 4 is an isolated view of the rotor used in the compressor shown in FIG. 1.

The position and the angle of the slots 28 for the vane 14 shown in FIG. 4 are determined in such a way that longer vanes can be held in the slots while the rotor still has sufficient strength. This arrangement greatly increases the vane extending length and hence the volumetric flow rate. The size, location, and the pattern of the oil grooves 29, which are very important, are determined in terms of sealing and lubrication. The end-disks **15*b*, 16*b* each have only one oil injection port 37*a*, 38*a* (FIG. 8) located near the seal zone (IV) of the compressor and between the high pressure side and low pressure side. Oil has to be brought and spread as much as possible over the whole area of each end-disk which contacts the rotor face. The oil grooves 29 trap sufficient oil and transport it to the area far away from the injection port 38*a*. Two piece-wise grooves between adjacent vanes are determined to eliminate the possible circumferential leakage of the gas through the grooves within which is the mixture of gas and oil. The rising of the grooves 29** (i.e., the increase of the groove radius) at the tail is to increase the oil spreading area. Experimental results showed that the seal is very good; a vacuum of thirty inches of mercury has been reached on the suction side while the discharge side remains at a pressure above 450 psig.

High machining quality is needed for the rotor 13 because a good sealing ability relies on a very small clearance between mechanical parts. The machining tolerance is limited at about 0.00025 inch using presently available CNC machines.

The vanes 14 are made of a self-lubricating polyimide material which contains 15% graphite and 15% P.T.F.E. (Teflon). As previously noted, this material is made by DuPont and marketed under the "VESPEL 211" trademark. It is lightweight and has a very small frictional coefficient when sliding on metal. The material was selected based on its compatibility with refrigerants and lubricants.

Since valve forces are the result of pressure multiplied by surface area, a large difference between the area exposed to the internal pressure and the area exposed to the external pressure leads to a large over-pressure required to open the valve. To reduce this effect, the valve seating area 36 (FIG. 7) is minimized, by relieving the area around the outside of the seating area 36 with the recessed area 22, so the valve blade 24 contacts on a small ring area 36, thereby minimizing the required pressure difference necessary for opening the valve.

The suction inlet 19 is located on one side of the compressor, i.e. the end-cap 16*a* in the illustrated embodiment. The shape of the inlet 19 fits the bore curvature 12 and has maximum area which covers the expansion cross-sectional area. The inlet 19 starts at point close to the sealing region (IV) and ends at Point C shown in FIG. 3. A sharp angle of about 45° is provided at the closing point C so that the vane 14 can isolate the chamber gradually, thereby reducing the noise created by the periodic suction. The gas is sucked into the compressor 10 axially from the side through the inlet 19. Because there is no intake valve, a suction pressure drop does not exist.

On smaller compressors, the rotor 13 is weakened by the vane slots 28. Thus, deformation of the rotor 13 and loss of parallelism in the rotor slots 28 can occur. To improve the strength at the root (the radially most inward portion) of the slot 28 on the rotor 13, the rotor shaft 30 and the rotor 13 can, for example, be made from one piece of high strength steel, e.g. 4340 steel alloy. The entire piece is hardened so that a good surface finish and wear resistance can be gained on both the rotor and shaft (bearing) surfaces. Larger compressors can, however, utilize a separate shaft pressed onto the rotor 13 since there is a greater amount of material and, therefore, greater strength in the root of the vane slots 28 to prevent deformation of the rotor 13.

High thermal efficiency and high pressure ratio are attained via another main advantageous feature of the invention, namely the lubricant internal sealing. The lubrication system is composed of oil injection ports 37*a*, 38*a*, oil supply grooves 37*b*, 38*b* (FIGS. 2 and 8), the oil trapping grooves 29 (FIG. 4), oil supply flow control orifices 42, and an oil-reservoir/oil separator 39. A working fluid-compatible oil must be used as a lubricant. For refrigeration systems, refrigerant-compatible oils such as SUNISO 3GS for R-12, R-22, R-114, R-113, R-500, etc., and Castrol SW68 for R-134a can be used as the lubricant which plays two roles in this compressor. First, it lubricates the mechanical moving parts, such as the vanes 14 and bearings, and, with the help of the oil grooves 29 on the rotor face, seals the leakage path by viscous effects. This is extremely important since the leakage path between the discharge ports 26 and the inlet 19 has a path length of only 0.1 inch and the pressure difference can be above 450 psi. If there were not any way to seal this leakage path, it would function like a narrow gap nozzle, and a significant quantity of compressed gas could be injected into the inlet side of the compressor 10, resulting in a tremendous loss in flow rate and pressure rise capability. This is particularly critical in small volume compressors.

The leakage rate is directly proportional to the fourth power of the gap width and inversely proportional to the fluid viscosity for a narrow gap low Reynolds flow situation. The width is minimized via high quality manufacturing. The viscosity of the lubricant is about 100 centipoise while the gas viscosity is only in the order of 0.01 centipoise. Therefore, the presence of oil in the sealing region results in a 10,000-times increase in viscosity, and thus a 10,000-times decrease in the leakage rate, if the leakage path is filled with oil. In this way, excellent sealing is obtained.

Figure 9:
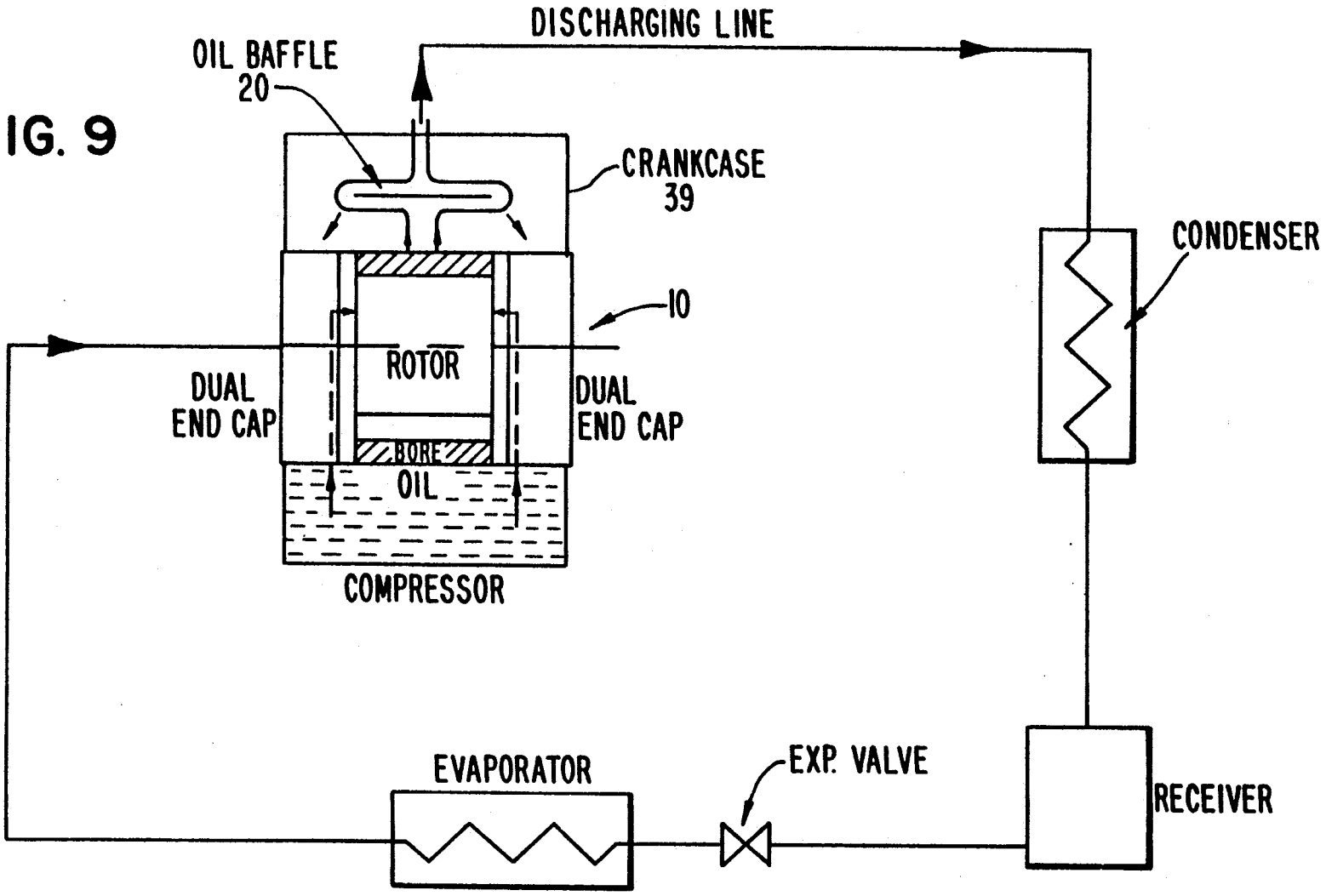
FIG. 9 is a schematic view of an embodiment of the compressor of the present invention having a crankcase as used in a conventional refrigeration system.

No pump is needed for supplying the lubricant to the required lubrication positions. The lubricant oil is pushed from its reservoir, which could be either a crankcase as shown in FIG. 9 or a separate oil-separator/oil-reservoir, into the compressor 10 by the high pressure produced by the compressor. FIGS. 2 and 8 show that the oil at high pressure (compressor discharging pressure) is transported to the oil supply ports 37*a*, 38*a* via the two orifices 42, and the two oil-supply lines 37*b*, 38*b*, one on each side of the compressor 10. It can be seen from FIG. 8 that the oil-supply line 38*b* is formed by grooves on the end-cap covered by an end-disk. The orifices 42 inside oil-supply lines 49 (i.e., at the bottom of the end-caps) act as a flow-control to assure that the correct amount of oil is sent to the compressor. The oil is injected into the compressor 10 from the oil injection ports 37*a*, 38*a*, through a pair of small holes on the end-disks 15*b*, 16*b*, and flows in the narrow clearance between the respective end-disk 15*b*, 16*b* and the rotor 13. The oil flows along this narrow passage under the combined influence of the pressure gradient and shear forces. Some of the oil is retained in the oil trap grooves 29 which are located on both faces of the rotor 14 as shown in FIGS. 1 and 4 and brought to the other part of the end-disk with the rotation of the rotor 13.

The location of the oil injection ports 37*a*, 38*a* is very critical to the performance of the lubricant seal, and further to the performance of the entire compressor. Within a small area around a oil injection port, there is a sharp pressure variation. If the oil injection ports deviate a little to the high pressure side, much less oil will be injected out; if they are too close to the low pressure side, part of the area supposed to be sealed will lack oil while too much oil will be flushed into the compressor. In both cases, the oil seal will not be sufficiently effective. The position of the injection port is precisely determined within that critical area so that the pressure at the location of the oil injection port can be at a desired value to have the best lubrication and sealing ability.

The oil reservoir has two functions, namely keeping the oil and separating the oil from the gas and oil mixture. An oil reservoir could be a crankcase type as seen in FIG. 2 or a separate oil reservoir. The separation function is accomplished with an oil baffle 40 (FIG. 2). In the illustrated crankcase reservoir, when the discharged gas and oil mixture passes through the oil baffle 40, the baffle allows discharged gas to exit, while the lubricant oil is separated from the gas and trapped in the crankcase 39 where it accumulates and is reintroduced into the compressor 10. This configuration is more compact and does not involve any fittings.

Figure 10:
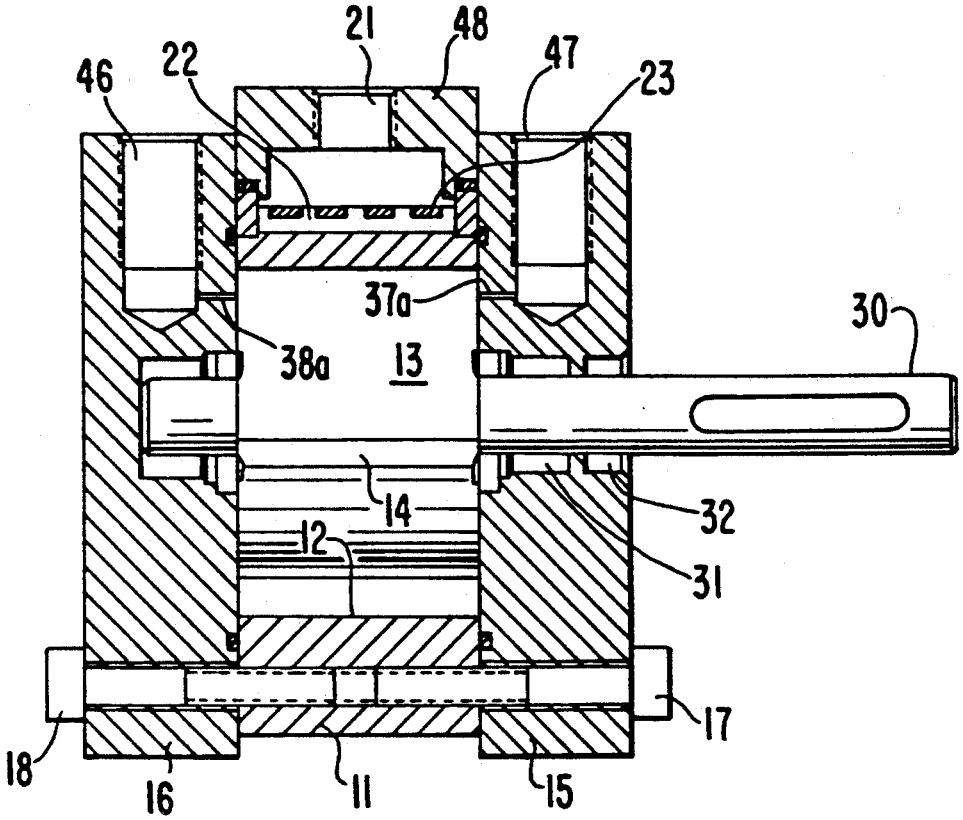
FIG. 10 is similar to FIG. 2, but shows a cross-sectional view of the compressor with a separate oil reservoir in the direction of arrows 2, 10 in FIG. 1.

In an embodiment of the present invention using a detached separator and reservoir, all the compressor exhaust, i.e. both the discharge gas and liquid oil, are routed to a separate detached oil-separator/oil-reservoir which, like the crankcase separator 39, is provided with one or more baffles to separate the liquid oil from the compressed gas. The oil is returned to the oil injection ports 37*a*, 38*a* (FIG. 10) on the compressor. It can be cooled prior to returning to the compressor 10. This configuration allows for an externally cooled reservoir/separator. The oil inside the separator/reservoir is also under high pressure and is able to be injected back into the compressor. A separate reservoir has the advantage of preventing the compressor from contacting the hot compressed exhaust gas and can therefore run cooler.

The shaft seal 32 is a conventional dual-lip seal and can be made, for example, of Graphite PTFE (teflon)

which has good wear resistance. Moreover, even if there is some wear, it will not degrade the sealing ability. A spring and the pressure on the lip will press the seal against the shaft 30. This assures the reliability of the seal 32 and its long life. A seal between the compressor and the crankcase is a conventional O-ring seal. The compressor assembly, i.e. the two end-caps 15*a*, 16*a*, the two end-disks 15*b*, 16*b* and the bore housing 11 are fastened together using the bolts 17, 18 with O-ring seals 45 (FIG. 2) therebetween in a known manner. This compact and lightweight structure replaces the conventional method of using large bolts and structure which seals the contact face by application of large surface forces.

Dual-metal structure, i.e. iron end-disks and aluminum end-caps, is used to reduce the weight of the compressor for some special needs such as a lightweight aircraft cooling systems or portable refrigeration systems. A thin cast-iron disk, which has good wearing resistance, is backed-up by a thicker, but lightweight, aluminum piece for housing the bearing, seal, inlet and mounting hardware. Another advantage of the dual metal end-caps is that the oil supplying grooves, as described above, can be engraved on the aluminum plate so no external supplying lines needed. The compressor 10 directly picks up the oil through the oil orifice 42 from the bottom of the crankcase oil reservoir 39.

The compressor bore housing 11 can likewise use two different metals for construction. Instead of a single cast iron bore housing, a thin cast-iron sleeve can be used to provide the wear resistance, and an outer aluminum housing can be used to provide the strength, and mounting surface.

Aside from conventional manufacturing techniques for other parts, the compressor bore configuration 12 is made by a 5-axis CNC milling machine which has a resolution of 0.0001 inch, based on the data of the bore configuration optimized with the FORTRAN program disclosed above. The end-caps can also be made on the same CNC 5-axis milling machine. All the precision-matching structures are made in one operation. Only one position pin 43 (FIG. 1) was used between the bore and the end-cap on each side. A minimum clearance between the bore and the rotor 13, i.e, the seal zone, is assured by pressing the bore 11 against the rotor 13 when the compressor 10 is assembled. Two pins 43, 44 are used to secure each end-disk 15*b*, 16*b* and match the holes 45, 46, respectively, shown in FIG. 8.

By way of illustration only, the overall size of a 1 horsepower compressor is about 3 inches diameter and 2.7 inches long excluding the crankcase. The displacement volume with that size compressor is 1.0955 cubic inches per revolution; 1,095.5 cubic inches per minute at 1000 RPM (0.634 $ft^3$/min) and 2,191.0 cubic inches per minute at 2000 RPM (1.268 $ft^3$/min). The highest operating pressure is 450 psig, and the lowest suction pressure is 30 inches Hg.

Figure 11:
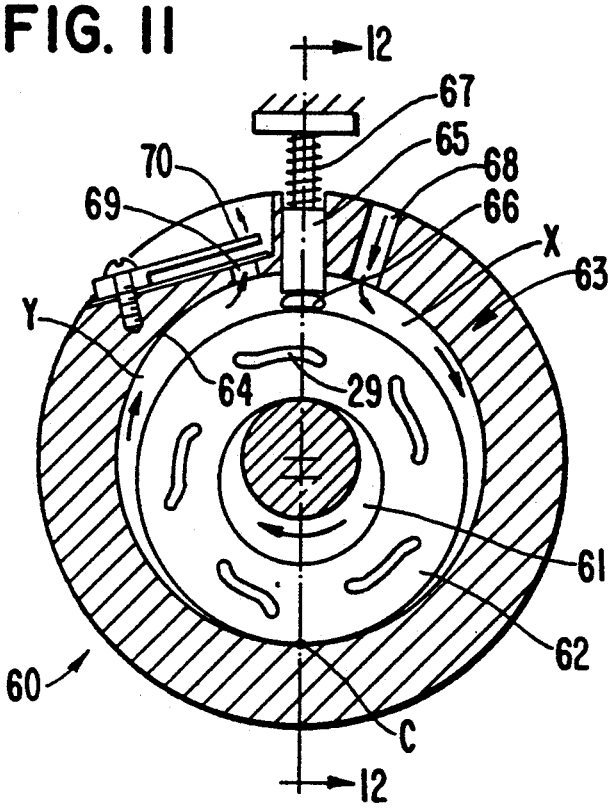
FIG. 11 is a cross-sectional front elevational view of a rolling piston-type rotary compressor employing principles of the present invention.
Figure 12:
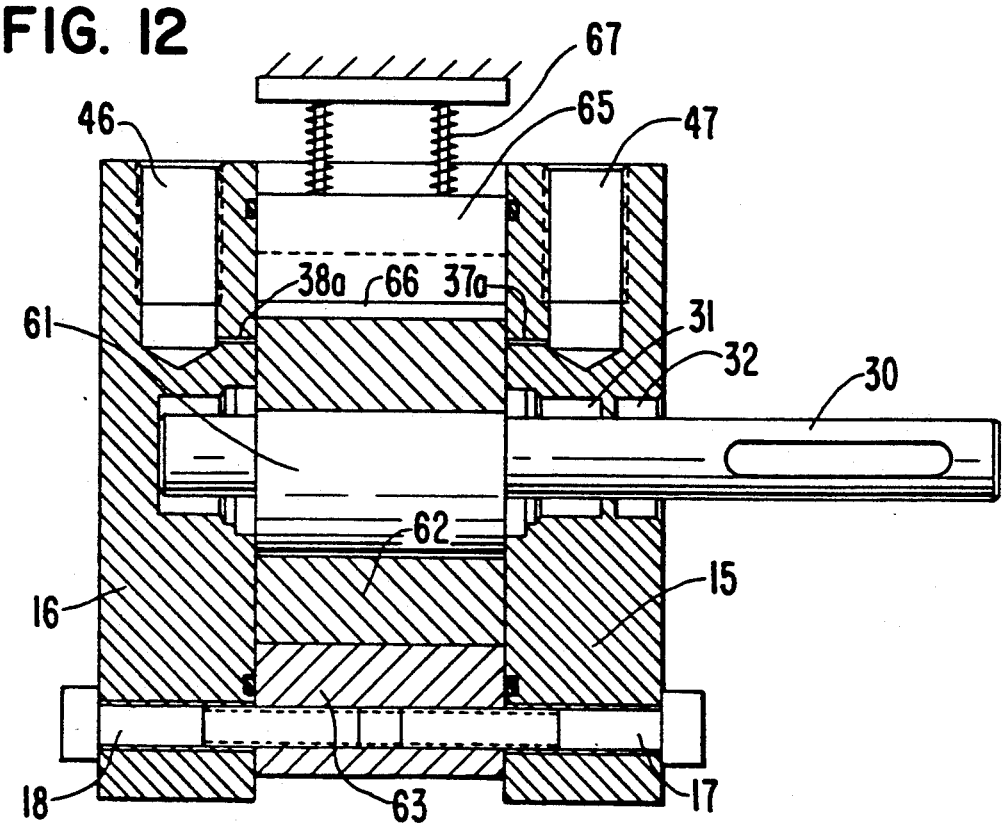
FIG. 12 is a cross-sectional view taken along line 12—12 FIG. 11 illustrating the lubricant injection ports.

FIGS. 11 and 12 show another type of generally known compressor, namely a rolling piston-type compressor, but one that incorporates principles of the present invention and designated generally by the numeral 60. The compressor comprises a housing 63 having a bore 64, a crankshaft-like rotor 61 arranged inside the bore 64, a crankshaft driven rolling piston 62 moving eccentrically inside the bore, a spring-based vane 65 and a face seal insert 66 between the vane 65 and the rolling piston 62. The rolling piston 62, the bore 64, and the vane 65 and insert 66 forms two variable chambers X, Y for gas suction and compression. The rolling piston 62 contacts the bore 64 at a contacting point C which rotates clockwise around the bore 64. When the contact point C passes the inlet port 68, a "new" chamber X is produced, and the "old" chamber X turns into chamber Y for a gradual compression operation.

The face seal insert 66 is provided between the vane 65 and the rolling piston 62 to form an area seal between the high pressure region and the low pressure region. The intake or inlet port 68 and the discharge port 69 are located on each side of the vane 65. A valve arrangement 70 is provided over the discharge port 69 and is constructed to operate substantially in the same way as valve assembly 23 shown in FIGS. 6 and 7. The lubrication and face seal system discussed with respect to FIGS. 1, 2, 4 and 8 is also essentially utilized in the rolling piston-type rotary compressor. The lubricant is injected into the gap between the rolling piston 62 and the end-caps 15, 16 through oil injection ports 37*a*, 38*a* (FIG. 12) and is trapped in oil grooves 29 (FIG. 11) and further transported to the other part of the face of the rolling piston.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A housing for a rotary compressor having a bore with a configuration made by a process in which a machine is controlled by and operated in terms of data obtained with a Fortran program as follows

```
c   initial data setup
c       write(*,*) 'This progrom is to determine the profile of
c       write(*,*) 'the bore. please input the r_rotor now'
c       read(*,*) r_rotor
c       write(*,*) 'please input the length the vane sticks out'
c       read (*,*) lv
        write(*,*) 'please input the endmill radius (inch) now'
        read(*,*) rm
c       rm =0.0
        rbmin=r_rotor + .0005
        rmin =rbmin-rm
        rbmax=r_rotor+lv
        rmax=rbmax-rm
        omg=2.*Pi*6500/60.
        a1=rmin
        b1=rmax
        theta1m=100.0
        a2=rmax
        b2=rmin
        theta2m=120.0
        n-2000
        write(*,*) 'please input the number of points'
        read(*,*) n
c   set theta dimension
        do 100 i=0,n+1
        dtheta=360./n
        theta(i)=dtheta*(i-1)
c       determine the radius as a function of theta
c   Region I, the seal region
        if (theta(i).ge.b) goto 20
        r(i)=rmin
C   Region II the expansion region 1
        if (theta(i).le.a) goto 100
        theta1=(theta(i)-10.)/theta1m *pi/2.
        r(i)=radius(a1,b1,theta1)
        goto 100
c   Region III, the transient region 2
    20  r(i)=rmax
        if (theta(i).le.c ) goto 100
c   Region IV, the compression region
```

-continued

```
      theta2=(theta(i)-c)/theta2m *Pi/2.
      r(i)=radius(a2,b2,theta2)
      goto 100
100   continue
      do 200 i =1,n+1
      vt=omg*r(i)*0.0254
      v=omg*(r(i)-r(i-1))*0,0254
      acel=omg*omg*(r(i)-0.3)*0.0254/9.81
      acelratio=(r(i+1)+r(i-1)-2.*r(i))*pi**2/(r(i)-0.3)
c     write(*,*)i, theta(i),r(i)
      x= r(i)*sin(theta(i)*PI/180.)
      y= r(i)*cos(theta(i)*Pi/180.)
      write(20,1000)theta(i),r(i), x,y
      write(30,2000) x,y
c     if (amod(i-1,5).ne.0) goto 200
c     write (20,1002)theta(i),r(i),vt,acel,v,acelratio
200   continue
c     do 300 i=1,100
c     theta(i)=360./99*(i-1)
c     x=0.7123*sin(theta(i)*pi/180.)
c     y=0.7123*cos(theta(i)*pi/180.)
c300  write(20,2000) x,y
c     to calculate the circumference of the profile
      cL3=0.0
      cL2=0.0
      r(n+1)=r(1)
      theta(n+1)=theta(1)+360.
      do 400 i=2,n+1
      cL2=cL2+r(i)*( (theta(i)-theta(i-1)) *pi/180.)
      cL3=cL3+r(i-1)*( (theta(i)-theta(I-1)) *pi/180.
400   continue
      write(*, *) 'circomference=',cL2,cL3,'de=',cL2/Pi
1000  format(1x,'|',f6.1,'|',f8.4,2('|',f8.4),'|')
1002  format(1x,f6.4,4(',',f13.4),',',f9.5)
2000  format(1x,'X',f7.4,'Y',f7.4)
      Stop
      end
      function radius(a,b,theta)
      radius=a/sqrt( 1.-(1.-a*a/(b*b))*sin(theta)*sin(theta))
      end,
      wherein
      r_rotor — rotor radius
      rmin, rmax - min. and max. radius
      a — the angle at which the first ellipse starts
      b — the angle at which the first ellipse ends the
      large circle are begins
      c — the angle at which the large circle ends and the
      second ellipse begins
      theta — angle variable (degree)
      r — radius variable (inch)
      x,y — point coordinates
      omg — rotating velocity
      Vt — tangential velocity
      V — Radial velocity
      acel — the tangential acceleration of the vane
      acelratio — the ratio of the radial accel. to the
      tangential accl
```

such that the bore has a configuration divided into an expansion region of elliptical shape, a circular transition region, a polynomial-shaped compression region, and a circular sealing region.

2. A rotary compressor comprising a housing having a bore; and vanes operatively arranged at the rotor assembly to move linearly relative to the rotor assembly and to form, together with the housing and rotor assembly, variably chambers, wherein the bore has a composite configuration divided into an expansion region of elliptical shape, a circular transition region, a polynomial-shaped compression region and a circular sealing region, and wherein the bore has a configuration made by a process in which a machine is computer controlled by and operated in terms of data obtained with a Fortran program as follows:

-continued

```
c     initial data.setup
c     write(*,*) 'This progrom is to determine the profile of
c     write(*,*) 'the bore. please input the r_rotor now'
c     read(*,*) r_rotor
c     write(*,*) 'please input the length the vane sticks out'
c     read (*,*) lv
      write(*,*) 'please input the endmill radius (inch) now'
      read(*,*) rm
c     rm =0.0
      rbmin=r_rotor + .0005
      rmin =rbmin-rm
      rbmax=r_rotor+lv
      rmax=rbmax-rm
      omg=2.*Pi*6500/60.
      a1=rmin
      b1=rmax
      theta1m=100.0
      a2=rmax
      b2=rmin
      theta2m=120.0
      n-2000
      write(*,*) 'please input the number of points'
      read(*,*) n
c   set theta dimension
      do 100 i=0,n+1
      dtheta=360./n
      theta(i)=dtheta*(i-1)
c     determine the radius as a function of theta
c   Region I, the seal region
      if (theta(i).le.b) goto 20
      r(i)=rmin
C   Region II the expansion region 1
      if (theta(i).le.a) goto 100
      theta1=(theta(i)-10.)/theta1m *pi/2.
      r(i)=radius(a1,b1,theta1)
      goto 100
c   Region III, the transient region 2
    20 r(i)=rmax
      if (theta(i).le.c ) goto 100
c   Region IV, the compression region
      theta2=(theta(i)-c)/theta2m *Pi/2.
      r(i)=radius(a2,b2,theta2)
      goto 100
100   continue
      do 200 i =1,n+1
      vt=omg*r(i)*0.0254
      v=omg*(r(i)-r(i-1))*0.0254
      acel=omg*omg*(r(i)-0.3)*0.0254/9.81
      acelratio=(r(i+1)+r(i-1)-2.*r(i))*pi**2/(r(i)-0.3)
c     write(*,*)i, theta(i),r(i)
      x= r(i)*sin(theta(i)*PI/180.)
      y= r(i)*cos(theta(i)*Pi/180.)
      write(20,1000)theta(i),r(i), x,y
      write(30,2000) x,y
c     if (amod(i-1,5).ne.0) goto 200
c     write (20,1002)theta(i),r(i),vt,acel,v,acelratio
200   continue
c     do 300 i=1,100
c     theta(i)=360./99*(i-1)
c     x=0.7123*sin(theta(i)*pi/180.)
c     y=0.7123*cos(theta(i)*pi/180.)
c300  write(20,2000) x,y
c     to calculate the circumference of the profile
      cL3=0.0
      cL2=0.0
      r(n+1)=r(1)
      theta(n+1)=theta(1)+360.
      do 400 i=2,n+1
      cL2=cL2+r(i)*( (theta(i)-theta(i-1)) *pi/180.)
      cL3=cL3+r(i-1)*( (theta(i)-theta(I-1)) *pi/180.
400   continue
      write  (*, *) 'circomference=',cL2,cL3,'de=',cL2/Pi
1000  format(1x,'|',f6.1,'|',f8.4,2('|',f8.4),'|')
1002  format(1x,f6.4,4(',',f13.4),',',f9.5)
2000  format(1x,'X',f7.4,'Y',f7.4)
      Stop
      end
      function radius(a,b,theta)
      radius=a/sqrt( 1.-(1.-a*a/(b*b))*sin(theta)*sin(theta))
      end,
      wherein
      r_rotor — rotor radius
      rmin, rmax - min. and max. radius
```

-continued a — the angle at which the first ellipse starts
b — the angle at which the first ellipse ends the large circle are begins
c — the angle at which the large circle ends and the second ellipse begins
theta — angle variable (degree)
r — radius variable (inch)
x,y — point coordinates
omg — rotating velocity
Vt — tangential velocity
V — Radial velocity
acel — the tangential acceleration of the vane
acelratio — the ratio of the radial accel. to the tangential accl.

3. The rotary compressor according to claim 2, wherein a curve to each of the regions is tangential at a point of conjunction with adjoining regions.

4. The rotary compressor according to claim 2, wherein the expansion region is defined by a crank angle of 100°, at an end of which adjoining the transition region the associated vane is fully extended.

5. The rotary compressor according to claim 2, wherein the vanes are arranged in slots in the rotor assembly with a position and angle of the slots sized to hold vanes of longer length without substantially decreasing strength of the rotor assembly.

6. The rotary compressor according to claim 2, wherein the valve assembly is arranged in a recessed area of the housing.

7. The rotary compressor according to claim 2, wherein an axial suction inlet is arranged at the expansion region.

8. The rotary compressor according to claim 2, wherein the rotor assembly has at least one oil grove on each end face thereof.

9. The rotary compressor according to claim 2, wherein the sealing region is configured as an area seal between a higher pressure discharge side and a lower pressure inlet side.

10. The rotary compressor according to claim 9, wherein the area seal is defined by the radii of the rotor assembly and the radius of the sealing region being substantially identical.

11. The rotary compressor according to claim 2, wherein end cap assemblies are provided at each face of the housing adjacent end faces of the rotor assembly and include at least one oil injection port and one oil supply line.

12. The rotary vane machine according to claim 11, wherein at least one oil groove is provided on the rotor and configured to trap a sufficient amount of oil, to transport the oil remotely from an injection post and to spread the oil.

13. The rotary compressor according to claim 2, wherein the vanes are comprised of self-lubricating material.

14. The rotary compressor according to claim 13, wherein the material is polyimide.

15. The rotary compressor according to claim 2 further comprising a valve assembly arranged in a recess of the housing, wherein the valve assembly comprises at least one thin flexible blade corresponding to at least one discharge port in the housing and normally covering the at least one discharge port in the absence of discharge pressure.

16. The rotary compressor according to claim 15, wherein the blade is spring steel.

17. The rotary compressor according to claim 15, wherein a retainer is arranged above the at least one flexible blade and is sized and configured to limit movement of an associated blade away from an associated one of the at least one discharge port.

18. The rotary compressor according to claim 15, wherein the housing comprises a crankcase-type oil reservoir.

19. The rotary compressor according to claim 15 wherein an oil reservoir is connected with the housing, and baffles are arranged in the reservoir so as to separate liquid from a liquid/gas mixture.

20. The rotary compressor according to claim 15, wherein the at least one discharge port is radially disposed in close proximity to a circular sealing region of the bore from the bore surface to a surface of the recess, and a sealing area at the discharge port for the at least one blade is relieved to minimize inside and outside pressure differences.

21. The rotary compressor according to claim 20, wherein at least one oil release groove is arranged along a surface of the bore at an entrance to the sealing region in proximity to the at least one discharge port so as to smoothly discharge liquids through the at least one discharge port.

22. The rotary compressor according to claim 20, wherein the at least one discharge port is substantially tangent to a cylindrical surface of the rotor assembly.

23. The rotary compressor according to claim 15, wherein oil grooves are distributed on faces of the rotor assembly and are configured to increase an oil spreading area.

24. The rotary compressor according to claim 23, wherein each side of the housing is provided with end cap assemblies adjacent the faces of the rotor assembly, said end cap assemblies comprising an end disk having an oil injection port and an end cap having an oil supply groove operatively associated with the oil injection port.

25. The rotary compressor according to claim 24 wherein a suction inlet is located in one of the end caps and is configured to fit a curvature of the bore in an elliptical expansion region of the bore, the suction inlet beginning proximate a circular sealing region of the bore and angled to allow a vane gradually to isolate the expansion region from an adjacent region in the bore.

26. The rotary vane compressor according to claim 24 wherein the end disks are made of a wear-resistant metal, and the end caps are made of lightweight material.

* * * * *